US005348467A

United States Patent [19]

Piffath et al.

[11] Patent Number: 5,348,467

[45] Date of Patent: Sep. 20, 1994

[54] CHILD RESISTANT CIGARETTE LIGHTER

[76] Inventors: Rodney S. Piffath, 10124 McBroom St., Sunland, Calif. 91040; John J. Cole, 20-76 33rd St., LIC Astoria, N.Y. 11105

[21] Appl. No.: 37,234

[22] Filed: Mar. 26, 1993

[51] Int. Cl.[5] ..... F23D 11/36

[52] U.S. Cl. ..... 431/153; 431/156; 431/277; 431/256

[58] Field of Search ..... 431/153, 156, 277, 234, 431/256, 130–135

[56] References Cited

U.S. PATENT DOCUMENTS 4,102,633 7/1978 Zellweger et al. ..... 431/277 X 4,687,437 8/1987 Springer ..... 431/277

*Primary Examiner*—Larry Jones

*Attorney, Agent, or Firm*—Wagner & Middlebrook

[57] ABSTRACT

A child resistant cigarette lighter is disclosed of the type employing a liquid reservoir of ignitable fluid, a friction wheel and flint for providing a spark and a user controlled valve for beginning and ending the flow of gaseous fuel to be ignited by the spark. The child resistant features include the location of the user controlled valve operator at a point on the reservoir body which is difficult if not impossible for a child to simultaneously operate the valve operator and the thumb wheel with a single hand.

14 Claims, 2 Drawing Sheets

FIG. 1
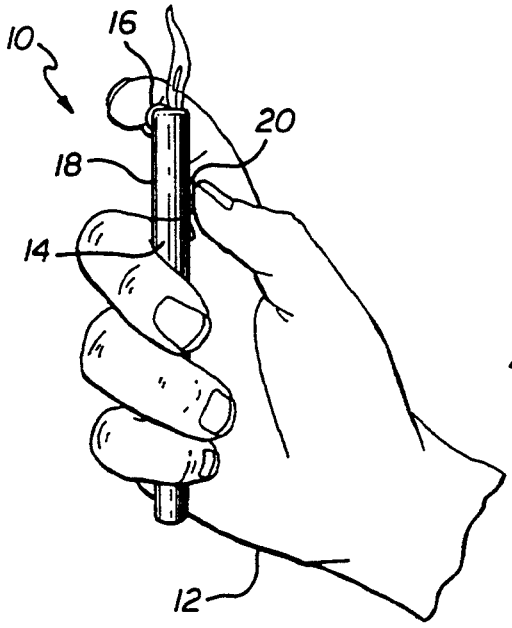
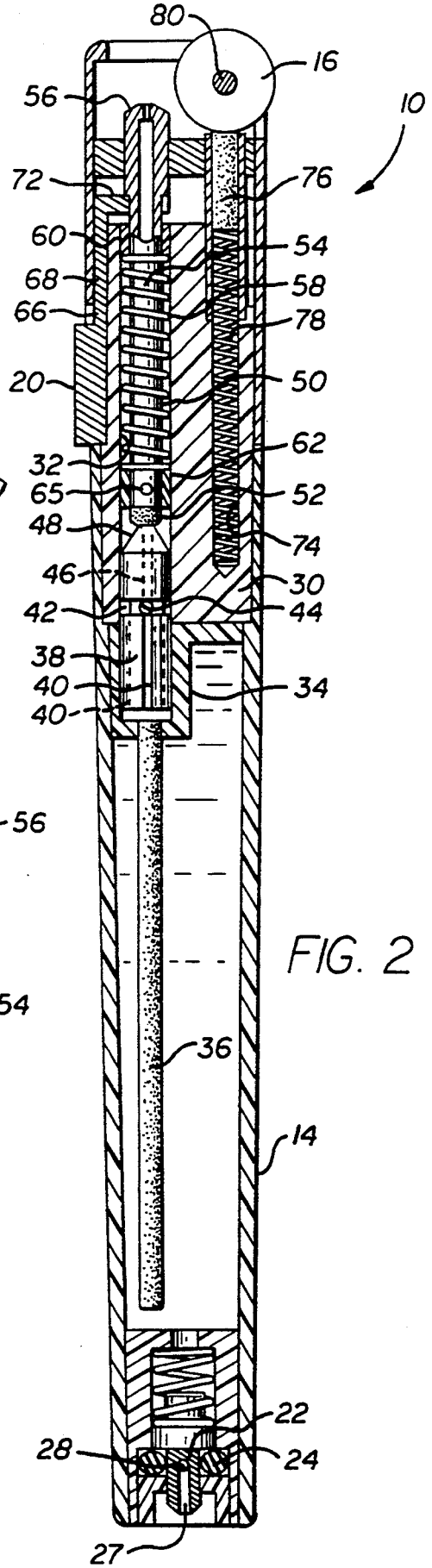
FIG. 2
FIG. 3
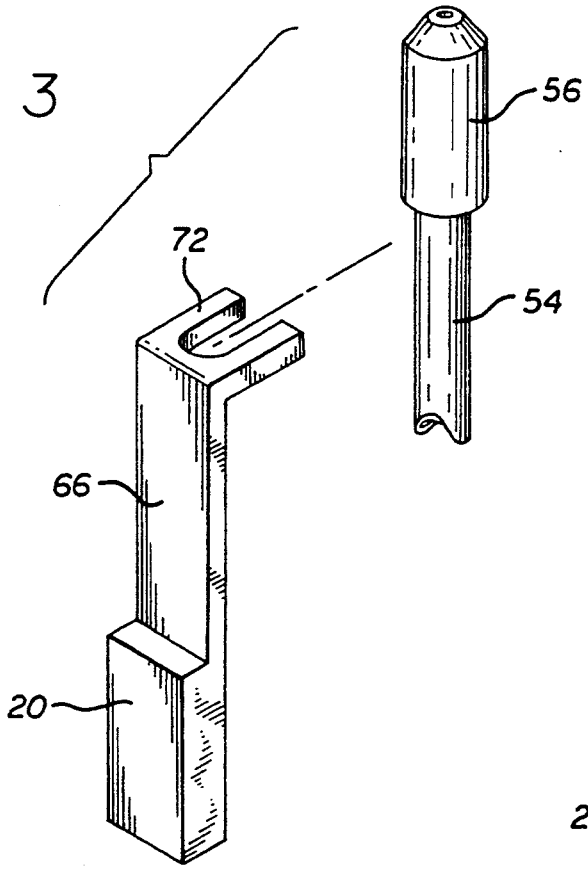

FIG. 4
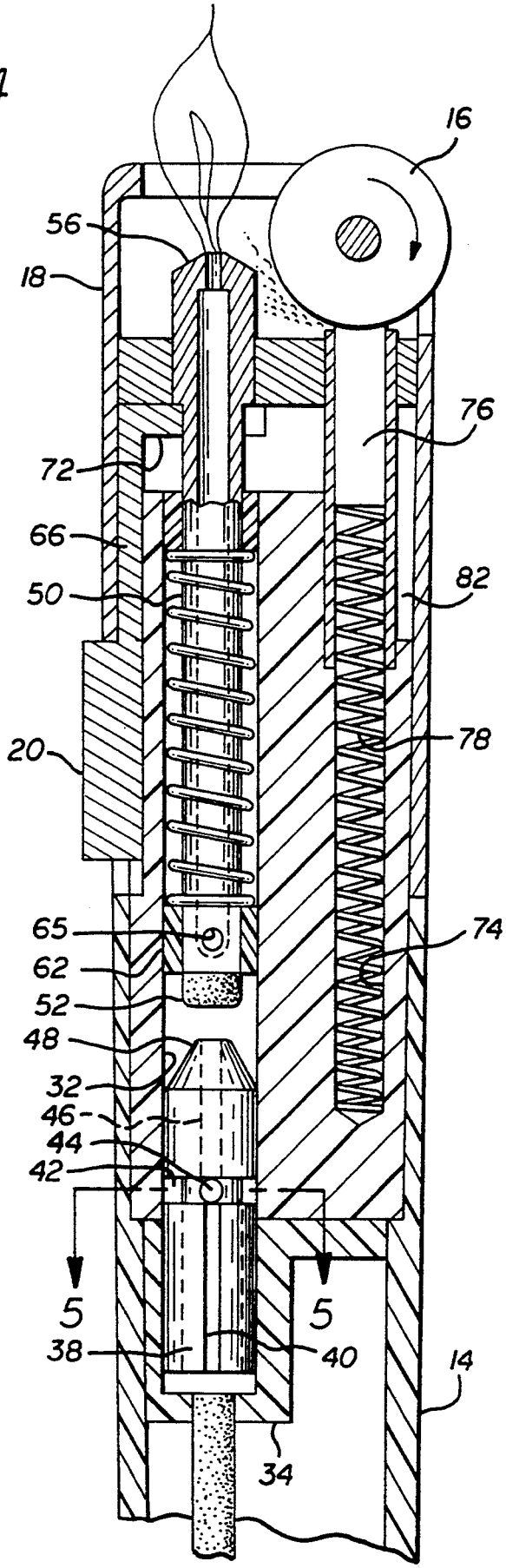
FIG. 5
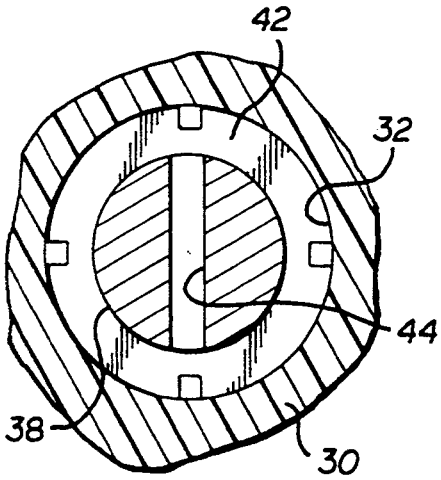
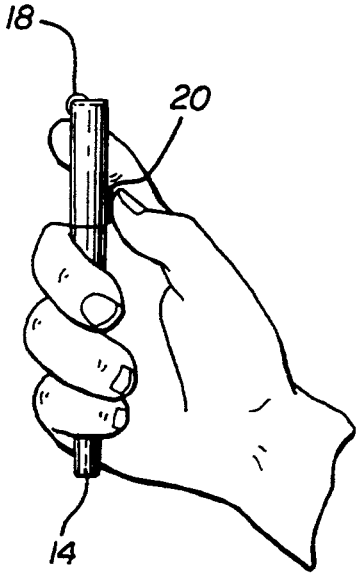
FIG. 6

CHILD RESISTANT CIGARETTE LIGHTER

BACKGROUND

This invention relates to cigarette lighters fueled by butane or other compressed or liquified gas.

Many such lighters are disposable, not refillable and very inexpensive. They tend to be become so commonplace that they are carelessly left sitting around where they become attractive to small children who frequently cause fires with such lighters.

Because of this recognized problem, federal regulations now require that such lighters include means for inhibiting operation by children. The lighter designs resulting from such regulations have generally involved attaching to or incorporating into an existing design, some means for inhibiting turning of the friction wheel. Some such means include a small thumb-operated member which must be moved both laterally and axially to release the friction wheel. Another such device provides a barrier to restrict the motion of the thumb lever that operates the gas valve of the lighter, which barrier must first be removed by operating a separate pin or tab. In each case an adult operating the lighter is required to go through one or two extra operations to put the lighter in condition to be operated. These extra operations are somewhat frustrating and annoying to the average adult desiring to use the lighter.

SUMMARY OF THE INVENTION

Applicants have chosen to reevaluate the requirements of such child resistant or safety lighters and have concluded that it should be possible to design a lighter which is extremely difficult if not impossible for small children to operate, and which yet may be operated by adults without the necessity for going through the extra operations discussed above. Applicants' lighter utilizes an ergonomic design which takes advantage of the fact that the hands of small children are limited in how far they can reach. The lighter is a slim design, usually cylindrical in cross section, whose length exceeds the span of the hands of most adults. This aids in gripping the lighter and at the same time provides a pleasing slim configuration. The cross section is only slightly larger than that of a cigarette, and the lighter may conveniently be carried in a cigarette package, although it is somewhat longer than most cigarettes.

To operate the lighter, one must push on a thumb operated member which is on one side of the lighter to open the gas valve and simultaneously operate the friction wheel which is displaced laterally a significant distance such as one inch and rotated 180 degrees around the lighter from the thumb operated member. An adult hand can easily operate the thumb operated member and at the same time reach and turn the friction wheel with the forefinger of the same hand. Experience has shown that small children cannot perform this operation. Two handed operation, though possible, is awkward and one must be aware of the need for simultaneous operation of the thumb operated member and the friction wheel. The thumb operated member is spring loaded so that it will shut off the gas valve immediately when thumb pressure is released.

The lighter includes an elongated cylindrical reservoir member having a wick and a fill valve at the bottom for filling the reservoir from a standard butane container so it is not a disposable lighter. Sealed to the top of the reservoir member is a cylindrical plug member having a longitudinal conduit therethrough. Positioned in the conduit close to the wick is a regulator member which provides a somewhat tortuous path terminating in an axial passage for the gas to pass through. The tortuous path with two or more ninety degree bends reduces the gas pressure to a desired level. A valve seat and seal are located at the end of the axial passage. The valve member is spring loaded to seal against the valve seat and includes an elongated pipe member communicating with a burner. The thumb operated member is moved axially translating a shaft in a slot on the surface of the plug member, the shaft terminating in a radially inwardly extending fork which clamps on the pipe member below the burner. Lifting of the thumb operated member causes the fork to lift the pipe and burner against the force of the spring, causing gas to flow through the pipe to the burner.

Adjacent to the fuel conduit and parallel thereto is a longitudinal bore containing a spring and a flint member. A friction wheel assembly is positioned at the top of the plug member such that the friction wheel is in contact with the top of the flint. The friction wheel assembly and the thumb operated member are secured to the plug member by means of a cylindrical collar. As indicated above, the lighter might be of square or elliptical cross section and the shape of the reservoir, plug member and collar would be defined by such shape.

DESCRIPTION OF THE DRAWINGS

FIG. 1 is a drawing of a lighter according to the invention in association with a person's hand showing the manner of operation.

FIG. 2 is a longitudinal cross section of the lighter of FIG. 1.

FIG. 3 is a perspective drawing of some specific elements of the lighter of FIGS. 1 and 2, FIG. 4 is a drawing on an enlarged scale and partly in section of the regulator and valve structure of FIG. 2;

FIG. 5 is a cross sectional view taken along line 5—5 of FIG. 4; and FIG. 6 is a drawing of the lighter in the hand of a child.

DESCRIPTION OF THE PREFERRED EMBODIMENT

Referring now to FIG. 1, a lighter 10 according to my invention is shown grasped in a hand 12 of an adult operator. The lighter includes a long relatively thin reservoir 14 of a suitable material, usually a plastic material, which contains butane.

A friction wheel 16 at the top of lighter 10 is partially confined by means of a collar 18 and is operated by the operator's forefinger. Located lower and on the opposite side of the lighter 10 is a thumb contact member 20 which is pushed upwardly with the operator's thumb to operate the gas valve. The entire lighter is normally from about 4 inches to 4½ inches long and about 7/16ths inch in diameter i.e. the length is in the order of nine times its diameter. The longitudinal distance between the thumb contact member 20 and the top of the friction wheel 16 is approximately one inch. Some variation in these dimensions is, of course, possible without departing from the teachings of the invention. As stated above, an adult can operate the lighter by grasping it as shown, pushing the thumb contact member 20 upwardly and simultaneously rotating the friction wheel 16 with a forefinger. This operation, while not immediately intuitive, is quite simple and natural once it is understood Yet applicants' experience has shown that a child, five years old or younger, never seems to operate the lighter successfully.

FIG. 2 is a longitudinal cross section of the lighter 10 of FIG. 1. At the lower end of the lighter is the reservoir 14 which may be filled with butane from a standard container through a conventional fill valve. This fill valve includes a piston valve 22 passing through an 0-ring seal 24 and which is urged in a closing direction by means of a spring 26. Pressure from below by the filling fixture on the butane container (not shown) causes piston valve 22 to be raised, permitting butane to flow through the center port 27 of piston valve 22 and out of porthole 28 into the interior of reservoir 14. This fill valve structure is conventional in the art.

Sealed to the top end of reservoir member 14 is a generally cylindrical plastic plug member 30 having an axial conduit 32 therethrough. Plug member 30 has an extension 34 extending into reservoir 14 which supports one end of a wick 36 suspended in the reservoir. This wick 36 acts to stabilize gas flow as it passes into conduit 32.

Fitting tightly into conduit 32 and its extension in member 34 is a gas pressure regulating member 38. Member 38 effectively acts as a plug in conduit 32 except for a plurality of fine longitudinal grooves 40 on its surface which permit a limited flow of gas toward an annular chamber 42 formed by a groove in the surface of regulating member 38. A lateral bore 44 through the diameter of member 38 connects gas in the annular chamber 42 with a central passageway 46 communicating with a valve seat 48 at the upper end of member 38.

A valve member 50 includes a seal 52 of an elastomeric material which is compatible with butane and which normally seals against valve seat 48. Valve member 50 includes an elongated tube or pipe 54 attached at its upper end to a burner 56. Surrounding pipe 54 is a spring 58 which is captured between a stationary bushing 60 and a bushing 62 which secures valve member 50 from lateral movement at its lower end and which permits gas flow to a port 65 near the lower end of pipe 54.

Positioned in a shallow axially directed groove on the exterior of plug 30 is a thumb lifter member 66 including shaft 68 and thumb contact member 20 at one end of shaft 68. At the opposite end of shaft 68 is a radially inwardly directed fork 72 which engages pipe 54 just below burner 56.

On the opposite side of plug 30 from conduit 32 is a bore 74 which is generally parallel to conduit 32 and which contains a flint 76 urged in an upward direction by means of a spring 78 against the friction wheel 16. That part of plug 30 to the right of bore 74 is split from the top of plug 30 down its side creating a slot adjacent bore 74 for part of its length. A support member for the friction wheel 16 is wedged in this slot and secured in position by collar 18 through a collet type action. Collar 18 also secures thumb lifter member 16 in place.

FIG. 3 is a perspective drawing showing the configuration of the thumb lifter member 66 and indicating its manner of connection with the pipe 54. As indicated, the fork 72 is pressed around the pipe 54 just below the burner 56. From FIGS. 2 and 3 it will be clear that if one pushes upward on the thumb contact 20 the pipe 54 will be lifted against the force of spring 58 thus pulling seal 52 off of valve seat 48 and permitting gas to flow from passage 64.

FIG. 4 is a sectional drawing of a portion of FIG. 2 on an enlarged scale. In FIG. 2 the thumb lifter member 66 is shown in its normal at rest position with the seal 52 closing on the valve seat 48. In FIG. 4 the thumb contact the thumb contact member 20 has been raised to the limit of its upward travel as permitted by its slot in collar 18. This causes fork 72 to lift the pipe 50 and burner 56, thereby raising seal 52 off of seat 48, and permitting gaseous butane fuel to pass by seal 52, part of the length of bushing 62 and through port 65 to the interior of pipe 50, then to the burner 56. If friction wheel 16 is turned simultaneously to strike sparks from the flint 76, the gas exiting the burner 56 will be ignited. It should be noted that bushing 62 is not a tight fit in conduit 32, so the butane ga readily finds its way to port 64. The function of bushing 62 is primarily to assure alignment of pipe 50 so that the pipe does not yet cocked or wedged against the upper bushing 60 or elsewhere along conduit 32 when the thumb contact member 20 is operated.

The support for friction wheel 16 includes an axle 80 mounted on a frame (unshown) secured in a groove 82 in the side of the plug 30. By wedging part of the frame 80 into groove 82 and then securing all the parts in position by attaching the collar 28, the frame 80 and friction wheel 26 are easily secured in the manner of a collet.

FIG. 5 is a crossectional drawing on an enlarged scale taken along line 5—5 of FIG. 4. The regulator member 38 is shown in conduit 32 in plug 30. The regulator member 38 is grooved at this point to form an annular chamber 42. The hole 44 cut through the diameter of regulator member 38 defines 2 ports connecting annular chamber 42 with the passages 64 on the inside of the regulator member 38. A plurality of very small passages 40 on the surface of regulator member 38 permit gaseous fuel from reservoir 14 to reach the annular chamber 42.

FIG. 6 is a drawing of a person's hand and the lighter similar to that of FIG. 1, but wherein the hand is that of a small child. Even when the lighter 10 is grasped properly, the child cannot simultaneously operate the thumb-contact 20 and the friction wheel 18. If the child's thumb is on contact 20, he or she cannot reach to operate the friction wheel 18. The usual reaction of a small child upon finding the lighter is to attempt to turn the friction wheel, ignoring the thumb contact entirely. After one or two turns of the friction wheel without success, the child abandons the lighter and goes on to other pursuits.

While only a single embodiment is described herein, modifications may be made within the scope of the present invention and I do not desire to be limited other than by the scope of the following claims including their equivalents.

We claim:

1. A child resistant butane lighter for operation by an adult sized hand, said lighter having a long generally cylindrical tubular housing including a fuel reservoir at one end, a flint and friction wheel at the opposite end, a burner adjacent said friction wheel and a fuel conduit communicating said reservoir with said burner, valve means in said fuel conduit, resilient means urging said valve means in a direction to interrupt flow to said burner, and thumb operated means movable axially upwardly to open said valve means against the force of said resilient means, said thumb operated means being displaced both longitudinally and radially from said friction wheel for simultaneous operation of said thumb-operated means with a thumb to open said valve means and for rotation of the friction wheel with a forefinger of said hand.

2. A child resistant butane lighter as claimed in claim 1 wherein said housing is of generally round cross section.

3. A child resistant butane lighter as claimed in claim 1 wherein a flow regulating means is located in said fuel conduit between said fuel reservoir and said valve means.

4. A child resistant butane lighter as claimed in claim 3 wherein said flow regulating means comprises a generally cylindrical member in said conduit having a plurality of fine axial passageways on its surface, a central passageway communicating with said valve means, an annular chamber communicating with said passageways, and a radial port connecting said annular chamber to said central passageway.

5. A child resistant butane lighter as claimed in claim 1 wherein said thumb operated means is longitudinally displaced from said friction wheel by approximately one inch.

6. A child resistant butane lighter as claimed in claim 1 wherein a wick is contained in said reservoir, part of said wick being positioned adjacent said flow regulating means.

7. A child resistant butane lighter as claimed in claim 1 wherein a generally cylindrical member is sealed to said reservoir, and said fuel conduit comprises a longitudinal passage through said cylindrical member.

8. A child resistant butane lighter as claimed in claim 7 wherein said valve means comprises a valve seat in said central passageway and a valve member urged by said resilient means against said valve seat, said valve member including a pipe communicating with said burner, and said thumb operated means includes a member in contact with said pipe such that movement of said thumb operated means lifts said valve member off its seat.

9. A child resistant butane lighter for operation by an adult sized hand, said lighter having an elongated housing including a fuel reservoir at one end, ignition means at the opposite end including a friction wheel operable by a forefinger of said hand, a burner adjacent said friction wheel, a fuel conduit communicating said reservoir with said burner, valve means in said conduit, resilient means urging said valve means in a closing direction, and thumb operated means located on the side of said housing and movably axially to open said valve means against the force of said resilient means, said thumb-operated means being displaced both longitudinally and radially from said ignition means for simultaneous operation of the thumb operated means and the ignition means.

10. A child resistant butane lighter as claimed in claim 9 wherein said elongated housing is generally cylindrical and the length of said housing is at least nine times its diameter.

11. A child resistant butane lighter as claimed in claim 10 where said fuel reservoir is tapered toward the bottom.

12. A child resistant butane lighter as claimed in claim 9 wherein a plug is fastened to said reservoir, said plug including a bore containing said fuel conduit and said valve means.

13. A child resistant butane lighter as claimed in claim 12 wherein said plug includes a shallow axially directed slot, and said thumb operated means includes a shaft axially movable in said slot and a fork member in contact with said valve means adjacent said burner.

14. A child resistant butane lighter including a fuel reservoir, a burner, a fuel conduit communicating said fuel reservoir with said burner, a flint and means supporting said flint in close proximity to said burner, a friction wheel and supporting means holding said friction wheel in contact with said flint, characterized in that said reservoir includes a wick, a plug fastened to said reservoir, a first longitudinal conduit through said plug, a gas flow regulator in said conduit, a valve seat in said conduit, a valve member in said conduit including a pipe having an internal passage communicating with said burner and resilient means urging said valve member against said seat, an external longitudinal slot on said plug, a thumb lifter member axially upwardly movable in said slot including a thumb contact member protruding from the side of said plug and radially inwardly directed prongs contacting said pipe adjacent said burner, a bore in said plug on the opposite side of said burner from said thumb lifter member, a spring in said bore urging said flint against said friction wheel, and a collar member securing said thumb lifter member in said slot, said reservoir, said plug and said friction wheel being generally in axial alignment to provide a lighter which is of an elongated configuration and wherein said thumb contact member and said friction wheel are on opposite sides of said lighter and longitudinally displaced such that they can be easily operated simultaneously only by an adult sized hand.

* * * * *